United States Patent [19]

Mode

[11] Patent Number: 4,562,926

[45] Date of Patent: Jan. 7, 1986

[54] COMPARTMENTED FOOD PLACEMAT

[75] Inventor: Duane R. Mode, Bloomington, Minn.

[73] Assignee: Champion International Corporation, Stamford, Conn.

[21] Appl. No.: 657,626

[22] Filed: Oct. 4, 1984

[51] Int. Cl.[4] ..... B65D 5/48; B65D 1/34

[52] U.S. Cl. ..... 206/563; 206/45.19; 206/218; 206/562; 229/27; 229/DIG. 13

[58] Field of Search ..... 206/45.19, 561, 562, 206/563, 218; 229/27, 28 R, DIG. 13

[56] References Cited

U.S. PATENT DOCUMENTS

| | | | |
|---|---|---|---|
| 2,512,963 | 6/1950 | Peiker | 206/563 |
| 2,670,124 | 2/1954 | Buchmiller et al. | 229/27 |
| 2,833,458 | 5/1958 | Toensmeier | 229/28 R |
| 2,983,368 | 5/1961 | Vander Lugt, Jr. | 206/45.14 |
| 3,140,035 | 7/1964 | Wenzel | 206/561 |
| 3,145,848 | 8/1964 | Wood | 229/28 R |
| 3,161,342 | 12/1964 | Wenzel | 229/28 R |
| 3,253,766 | 5/1966 | Coe | 229/28 R |
| 3,434,649 | 3/1969 | Goings | 206/563 |
| 3,899,119 | 8/1975 | Roccaforte | 206/562 |

*Primary Examiner*—William T. Dixson, Jr.
*Assistant Examiner*—Brenda J. Ehrhardt
*Attorney, Agent, or Firm*—Evelyn M. Sommer; William W. Jones

[57] ABSTRACT

An article including a placemat is formed from paperboard and includes a plurality of compartments for holding foodstuffs and a beverage container. The article is made from a one-piece paperboard blank which is precut, scored and glued to a flat storage configuration. The compartments are expandable prior to use with internal walls which are deflected to hold the compartments in their expanded form.

1 Claim, 5 Drawing Figures

COMPARTMENTED FOOD PLACEMAT

This invention relates to a food serving article which is formed from a one-piece blank of paperboard. The article has an expandable compartment portion and an adjacent placemat panel.

Serving of food at fast food outlets and on airplanes, trains and the like is typically done by placing the food in some type of box or like container and then using a separate tray of some sort to support the several containers of food and beverages. The tray is typically made of plastic and is reusable. In some cases, placemats may be used. The placemats are typically printed with advertising material and are made of paper so as to be disposable after use. In the serving of snacks on airplanes or the like, it is likely that no tray or placemat will be used.

This invention relates to a food serving article which can be characterized as a combination tray and placemat. The article is formed from a cut and scored one-piece paperboard blank which is preliminarily formed into a flat storage configuration. One portion of the article is expandable from the flattened configuration to an erected configuration to form several compartments which can be used to hold containers of food and a beverage container. Another portion of the article serves as a tray or placemat. The two portions are adjacent to each other for ease of use. Deflectable wall panels are provided to hold the expandable portion of the article in its erected configuration. After use, the article can be discarded.

It is, therefore, an object of this invention to provide a food serving article which is made from paperboard and which includes container retaining compartments and an adjacent flat tray/placemat portion.

It is a further object of this invention to provide a food serving article of the character described which can be converted from a flat storage condition to an erected operable condition.

It is an additional object of this invention to provide a food serving article of the character described which includes foldable wall panels operable to hold the compartments in the erected operable condition.

These and other objects and advantages of the invention will become more readily apparent from the following detailed description of a preferred embodiment thereof when taken in conjunction with the accompanying drawings, in which.

Figure 1:
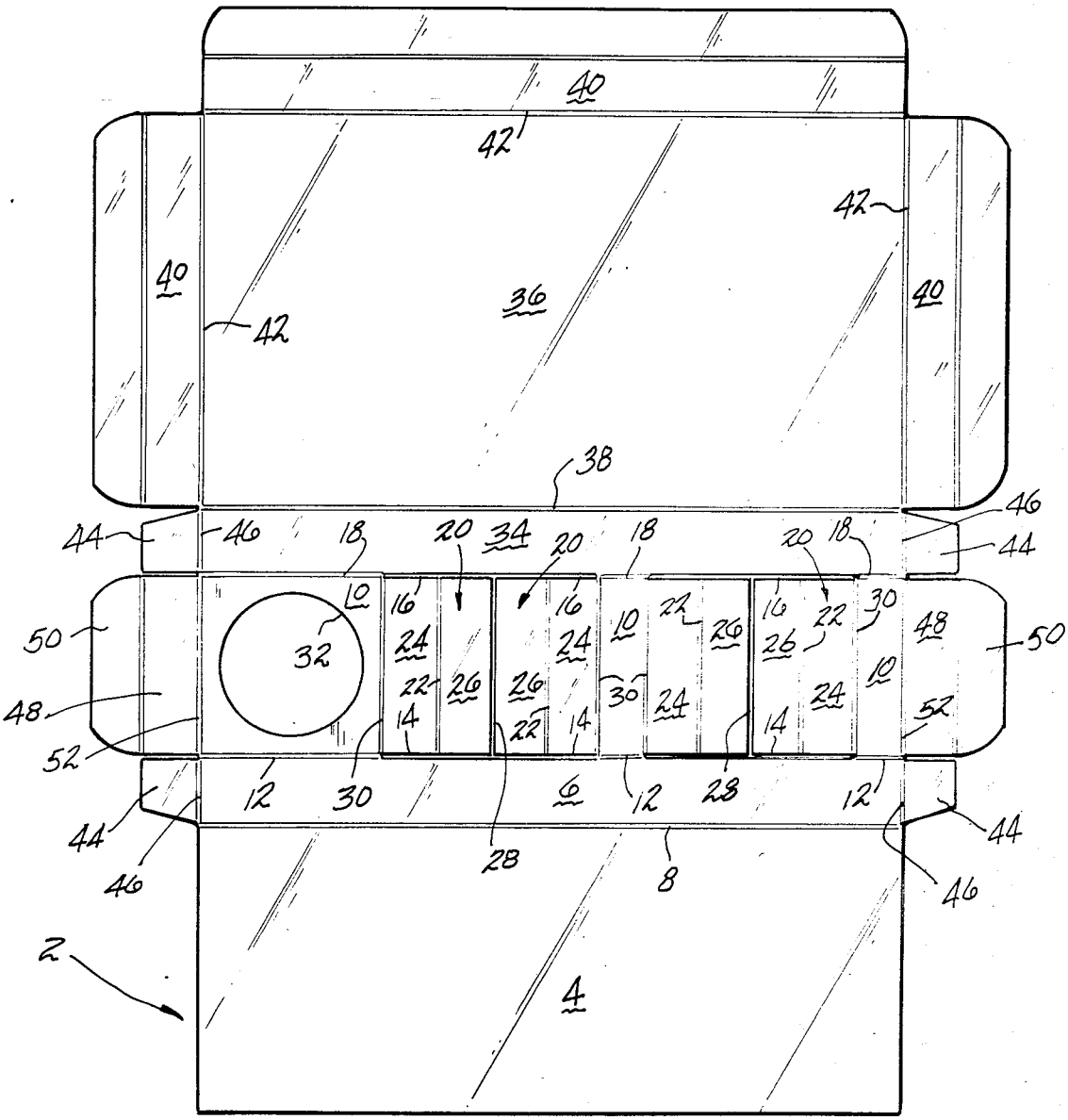
FIG. 1 is a plan view of a cut and scored paperboard blank from which a preferred embodiment of a food serving article of this invention can be formed.
Figure 2:
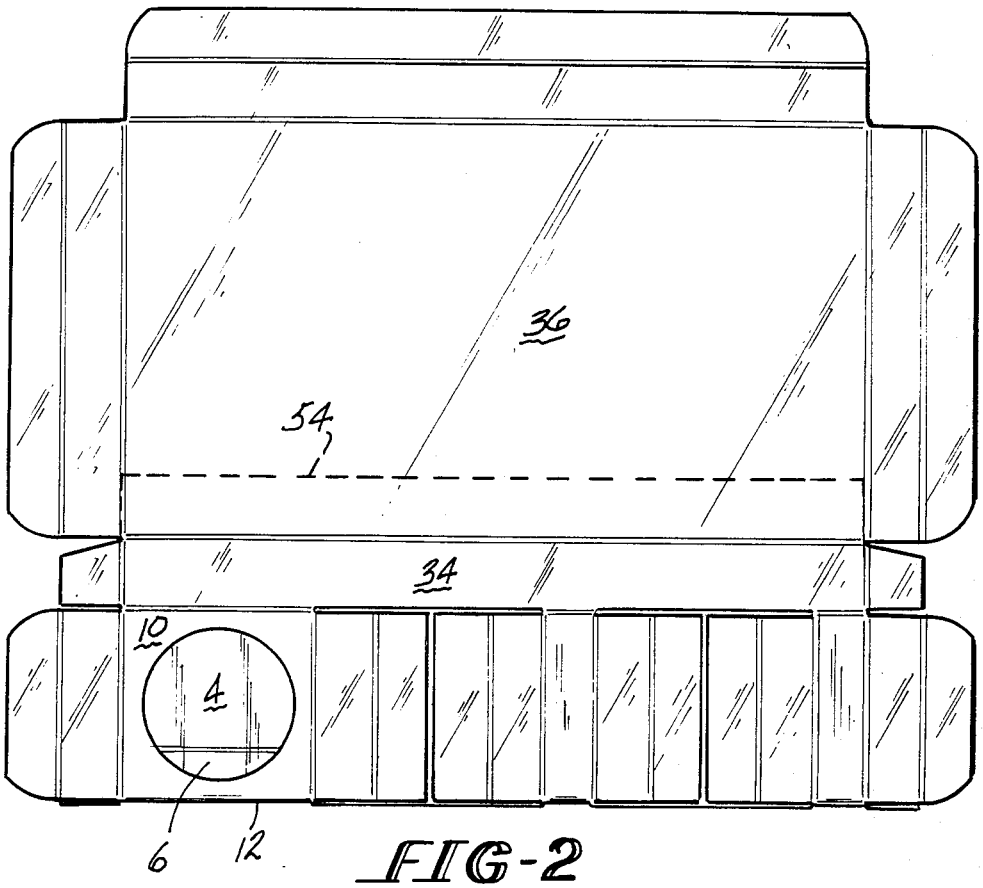
FIG. 2 is a plan view of the top of the flattened storage form of the food serving article which is produced by folding the blank of FIG. 1.

Referring now to FIG. 1, the blank denoted generally by the numeral 2 includes a bottom wall panel 4 connected to an outer side wall panel 6 along a fold line 8. A top wall panel 10 is connected to the outer side wall panel 6 along a fold line 12. The top wall panel 10 includes a plurality of cuts 14 and 16 which form side edges of deflectable panels 20 which are divided by transverse fold lines 22 into first and second panels 24 and 26. Transverse cuts 28 form the end edges of the deflectable panels 20. The cut lines 14 and 16 are colinear with the fold lines 12 and 18 respectively. The deflectable panels 20 are connected to the top panel 10 along transverse fold lines 30. A circular opening 32 is formed in the top panel 10. An inner side wall panel 34 is connected to the top panel 10 by the fold line 18 and a tray or placemat panel 36 is connected to the inner side wall panel 34 by a fold line 38. Flanges 40 are connected to the edges of the placemat panel 36 by fold lines 42. Tuck tabs 44 are connected to ends of the inner and outer side wall panels 34 and 6 respectively by fold lines 46. End wall panels 48 having tuck tabs 50 are connected to opposite ends of the top wall panel by fold lines 52.

Figure 3:
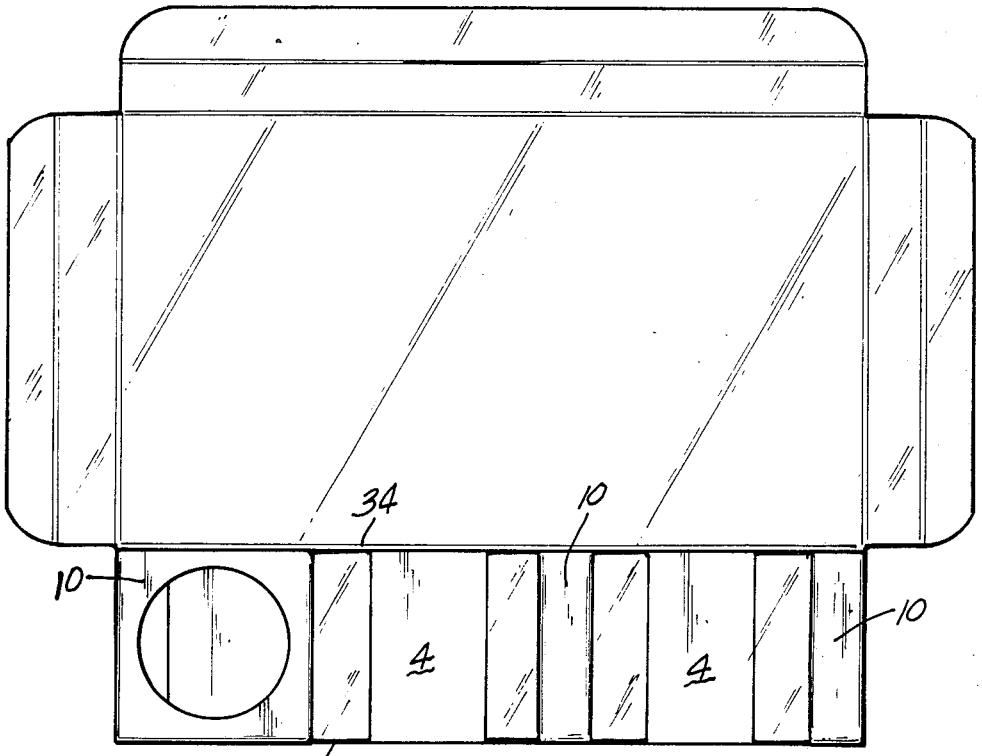
FIG. 3 is a top plan view of the food serving article shown in its erected condition by further folding the form shown in FIG. 2.
Figure 4:
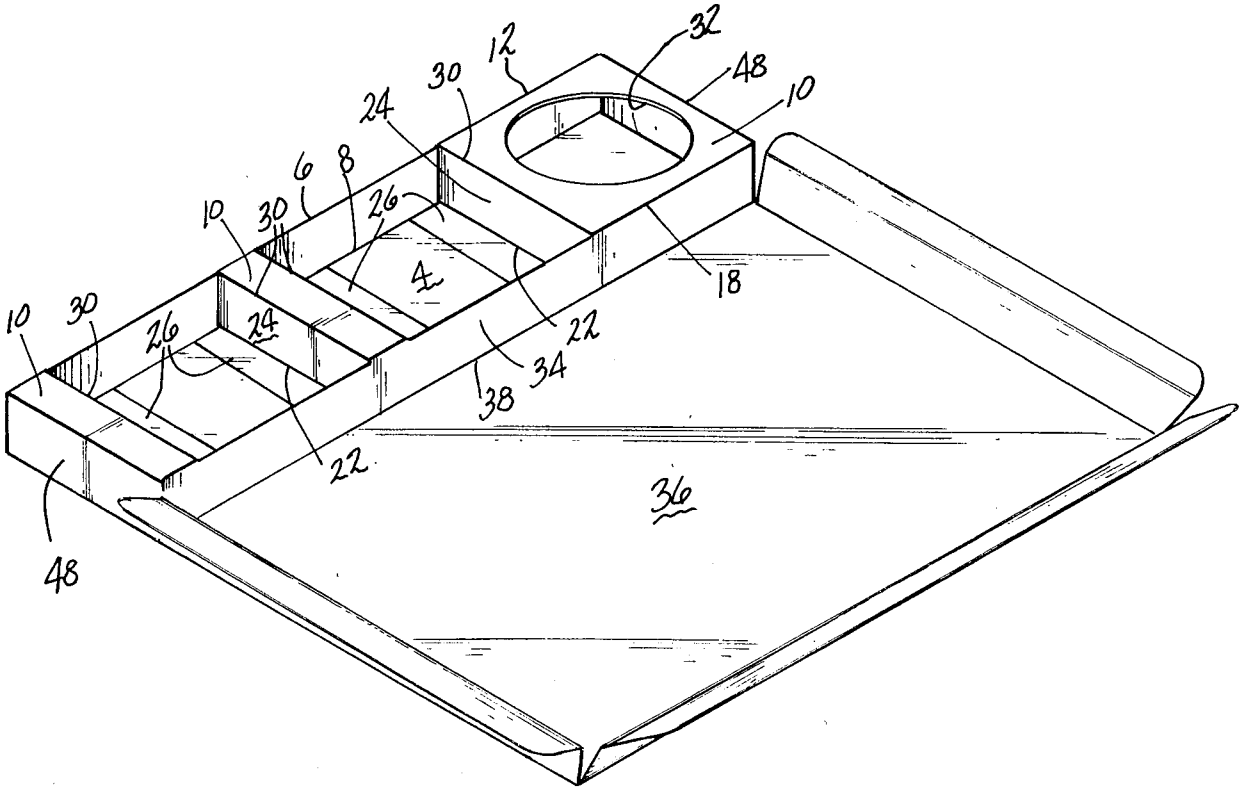
FIG. 4 is a perspective view of the erected article of FIG. 3.

To form the flattened storage and bulk shipping configuration of the article, the outer side wall panel 16 and the bottom wall panel 4 are folded about the fold line 12 under the top wall panel 10 so that the free edge 54 of the bottom wall panel underlies the placemat panel 36, and the bottom wall panel 4 is adhered to the under side of the placemat panel 36. In this form, the top wall panel 10 overlies and is face-to-face with the outer side wall panel 6 and the bottom wall panel 4, and the inner side wall panel 34 overlies and is face-to-face with the bottom wall panel 4. To expand the article to the form shown in FIGS. 3 and 4, the outer and inner side wall panels 6 and 34 are pivoted about the fold lines 8, 12, 18 and 38 until the panels 6 and 34 are perpendicular to the bottom wall panel 4. The flaps 44 and end wall panels 48 are then folded in perpendicular to the side wall panels 6 and 34 and the top wall panel 10 into overlapping relationship, and the tuck flaps 50 are tucked in and disposed in face-to-face contact with the bottom wall panel 4. The panels 24 are then pivoted down about the fold lines 30, and the panels 26 are folded about the fold lines 22 into overlapping face-to-face contact with the bottom wall panel 4. The panels 24 and 48 thus serve to hold the compartmented portion of the article in its expanded condition. The opening 32 provides a beverage container compartment, and the panels 6, 34 and 24 combine with the bottom wall panel 4 to provide a pair of food container compartments. The placemat panel 36 is conveniently available to support what is being eaten, or eating utensils or the like. When one is finished with the article, it can be restored to its flattened condition and conveniently discarded in this non-bulky form. The flanges 40, when included, can be used as a convenient means for gripping the article during serving.

Figure 5:
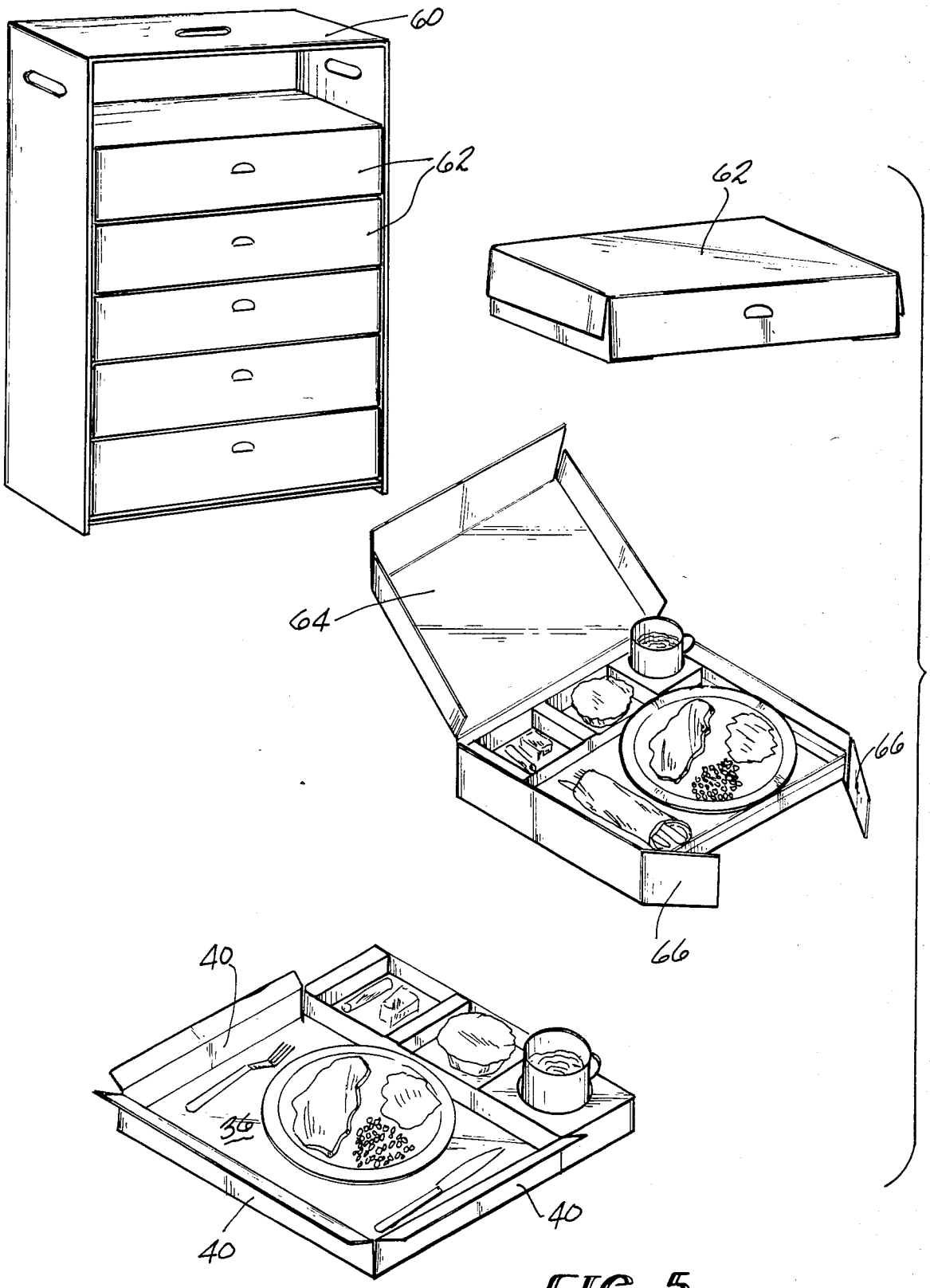
FIG. 5 is a perspective view of a serving sequence whereby the food serving article may be used.

One manner of serving food with the article is shown sequentially in FIG. 5. A storage box 60 having an open front is used to hold a plurality of cartons 62 stacked one on top of the other. The cartons 62 will be removed one at a time and given to the diner. The carton 62 has a top 64 which pivots open and two front flaps 66 which swing open so that the article of this invention can be slid out of the carton onto a table or tray, or the like. It will be noted that the flanges 40 on the tray will be folded up to give a perimeter to the placemat panel 36.

It will be appreciated that the article of this invention is inexpensive to produce while providing the convenience of both a food container support and a tray or placemat. It can be shipped and stored in a compact flat configuration and can be easily converted to its expanded configuration when ready for use. When finished, the article can be discarded.

Since many changes and variations of the disclosed embodiment of the invention may be made without departing from the inventive concept, it is not intended to limit the invention otherwise than as required by the appended claims.

What is claimed is:

1. A food serving article formed from a one-piece blank of paperboard material, said article comprising:

(a) a placemat panel;

(b) an inner side wall panel foldably connected to a first edge of said placemat panel;

(c) a top wall panel foldably connected to said inner side wall panel;

(d) an outer side wall panel foldably connected to said top wall panel;

(e) a bottom wall panel foldably connected to said outer side wall panel, said bottom wall panel lapping and being secured to a bottom surface of said placemat panel;

(f) said top wall panel including at least one article-receiving opening formed by a pair of opposed deflectable panels cut from the material of said top wall panel and foldably connected thereto;

(g) said inner side wall panel being pivotable from a collapsed position coplanar with said placemat panel and said top wall panel to an erected position perpendicular to said placemat panel and said top wall panel while said outer side wall panel is pivotable concurrently from a collapsed position coplanar with said bottom wall panel to an erected position perpendicular to said bottom wall panel and said top wall panel wherein said top wall panel is spaced apart from said bottom wall panel;

(h) said deflectable panels being pivotable from a collapsed position coplanar with said top wall panel to an erected position wherein a first portion of each of said deflectable panels is disposed perpendicular to said top wall panel, and a second portion of each of said deflectable panels foldably connected to said first portion overlies said bottom wall panel whereby said deflectable panels are operable to retain said top wall panel and side wall panels in their erected positions;

(i) flange panels foldably connected to second, third and fourth edges of said placemat panel, said flange panels being free of hinged connections with each other so as to form peripheral walls about said placemat panel wherein the individual flange panels may be pivoted with respect to said placemat panel independently of each other, whereby said flange panels allow gripping of the food serving article in planes substantially coplanar with said placemat panel, and provide a peripheral barrier for objects on said placemat panel in planes substantially perpendicular to said placemat panel; and (j) end wall panels foldably connected to opposite ends of one of said bottom and top wall panels, said end wall panels having terminal tuck tabs foldably connected to ends thereof, said end wall panels being foldable toward the other of said bottom and top wall panels and said tuck tabs being insertable behind the other of said bottom and top wall panels to further brace said top and side wall panels in their erected positions.

* * * * *